US012721387B2

(12) United States Patent
Anderson et al.

(10) Patent No.: US 12,721,387 B2
(45) Date of Patent: Sep. 1, 2026

(54) TRANSFORMABLE MODULAR GARMENT

(71) Applicants: Tara Anderson, Macon, GA (US); Ronnie Barentine, Rochelle, GA (US)

(72) Inventors: Tara Anderson, Macon, GA (US); Ronnie Barentine, Rochelle, GA (US)

( * ) Notice: Subject to any disclaimer, the term of this patent is extended or adjusted under 35 U.S.C. 154(b) by 0 days.

(21) Appl. No.: 19/185,385

(22) Filed: Apr. 22, 2025

(65) Prior Publication Data

US 2026/0053218 A1 Feb. 26, 2026

Related U.S. Application Data

(63) Continuation-in-part of application No. 18/813,390, filed on Aug. 23, 2024, now abandoned.

(51) Int. Cl.

| | |
|---|---|
| ***A41D 15/04*** | (2006.01) |
| ***A41D 3/08*** | (2006.01) |
| ***A41D 27/20*** | (2006.01) |

(52) U.S. Cl.

CPC ..... *A41D 15/04* (2013.01); *A41D 3/08* (2013.01); *A41D 27/20* (2013.01); *A41D 2400/26* (2013.01)

(58) Field of Classification Search

CPC ..... A41D 15/04; A41D 13/08; A41D 27/20; A41D 2400/26; A45F 4/12

See application file for complete search history.

(56) References Cited

U.S. PATENT DOCUMENTS

| | | | | | |
|---|---|---|---|---|---|
| 1,220,088 | A * | 3/1917 | Gavin | A41D 3/08 | 2/88 |
| 1,496,283 | A * | 6/1924 | Wright | A41D 15/00 | 2/88 |
| 1,509,296 | A | 9/1924 | Hopewell | | |
| 1,804,346 | A * | 5/1931 | Kirschenbaum | A41D 1/02 | 2/139 |
| 2,024,044 | A | 12/1935 | Johnson | | |
| 2,372,110 | A * | 3/1945 | Noone | A41D 3/08 | 5/413 R |
| 3,590,864 | A * | 7/1971 | Vechesloff | A45F 4/02 | 135/96 |
| 3,707,729 | A * | 1/1973 | Scarsella | A41D 3/08 | 2/88 |
| 4,258,439 | A * | 3/1981 | York | A47G 9/064 | 2/88 |

(Continued)

*Primary Examiner* — Alissa L Hoey
(74) *Attorney, Agent, or Firm* — H. Brock Kolls

(57) ABSTRACT

A wearable textile apparatus is configurable for use as a towel, cape, backpack, or cover-up. The apparatus includes a fabric body having an exterior surface, an interior surface, a neckline, opposed lateral edges, and armholes. Exterior pockets are positioned on the exterior surface with open ends facing a vertical center reference line. Fasteners positioned proximate to the neckline are configured to interconnect across a chest of a wearer to position the pockets for frontal access. Removable sleeves are attachable around the armholes, and a detachable hood can be aligned with a contoured neckline. Optional modular accessories include a collar and a decorative bow attachable at predetermined reference locations. The apparatus can be selectively arranged as a wearable cape, a flat towel, a backpack, or a torso-covering garment based on the arrangement of the fasteners and modular components.

19 Claims, 11 Drawing Sheets

(56) References Cited

U.S. PATENT DOCUMENTS 4,347,629 A * 9/1982 Itoi ..... A45F 4/12 2/108
4,484,362 A * 11/1984 Asher ..... A45F 3/22 5/413 R
5,226,193 A * 7/1993 Chen ..... A47G 9/083 2/69.5
5,463,783 A * 11/1995 Pope ..... A45F 4/02 2/88
5,629,071 A * 5/1997 Feldman ..... A45C 9/00 428/101
5,815,833 A * 10/1998 Kuo ..... A47G 9/086 5/413 AM
5,875,492 A * 3/1999 Moss ..... A47G 9/064 2/87
5,924,132 A * 7/1999 Wigutow ..... A45F 4/14 2/69.5
6,408,462 B1 * 6/2002 Moore ..... A45F 4/02 2/84
6,708,343 B1 * 3/2004 Ceron ..... A41D 15/04 2/84
7,178,185 B1 * 2/2007 Nattler ..... A41D 15/04 2/84
8,468,612 B1 * 6/2013 Galloway ..... A41D 27/20 2/207
8,485,596 B1 * 7/2013 Martin ..... A47C 7/748 2/84
8,640,262 B2 * 2/2014 Rossi ..... A41D 7/008 2/84
8,650,664 B2 * 2/2014 Parr ..... A41D 3/00 2/87
9,615,610 B2 * 4/2017 Biller ..... A41D 3/00
9,700,086 B2 7/2017 Gamble
9,723,882 B2 * 8/2017 Reuben ..... A41D 15/002
9,763,485 B1 * 9/2017 Weitala ..... A41D 3/08
10,231,560 B2 * 3/2019 Carlile ..... A47G 9/062
11,627,768 B2 * 4/2023 Pearson ..... A41D 15/04 2/85
11,812,798 B2 * 11/2023 Blanton ..... A41D 15/002
2007/0083971 A1 4/2007 Scully
2008/0172788 A1 * 7/2008 Rosen ..... A47G 9/064 5/417
2009/0031473 A1 * 2/2009 Hartfield ..... A41D 3/08 2/87
2010/0146680 A1 * 6/2010 Cuoco ..... A41D 3/08 2/84
2011/0258749 A1 10/2011 Hibbs
2012/0047630 A1 * 3/2012 Gare ..... A41D 27/08 2/244
2013/0074244 A1 3/2013 Cole
2013/0333090 A1 * 12/2013 Bruno ..... A45D 44/08 2/50
2015/0143604 A1 * 5/2015 Mizrahi ..... A42B 1/048 2/84
2015/0296898 A1 * 10/2015 Bowen ..... A47K 10/02 2/69
2016/0353816 A1 * 12/2016 Strace ..... A45F 4/02
2018/0213952 A1 * 8/2018 Penn ..... A47G 9/064
2018/0255853 A1 9/2018 Spathas
2021/0153576 A1 * 5/2021 Williams ..... A41D 15/002
2021/0329984 A1 10/2021 Arizmendi
2022/0117334 A1 * 4/2022 Hansen ..... A47K 10/02
2022/0132944 A1 * 5/2022 Strong ..... A41D 13/12 2/88
2022/0312870 A1 * 10/2022 Sechrist ..... A41D 15/00
2023/0225425 A1 * 7/2023 Warren ..... A41D 1/02 2/93
2023/0240387 A1 * 8/2023 Bensch ..... A41D 3/08 2/88
2024/0065347 A1 2/2024 McCray

* cited by examiner

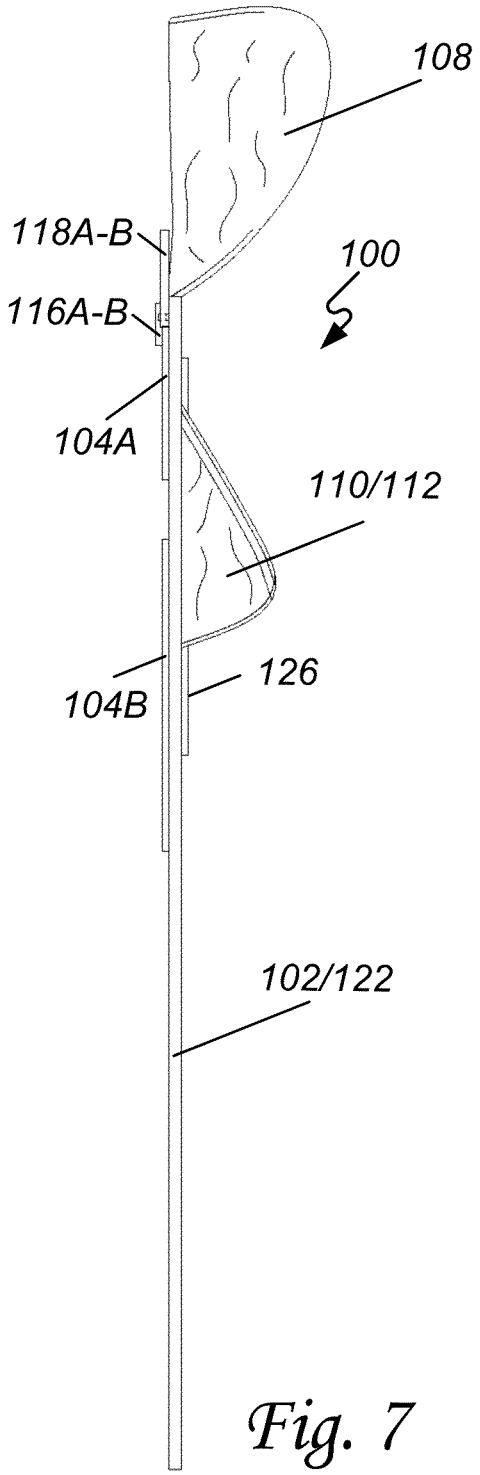
Fig. 7
Fig. 8
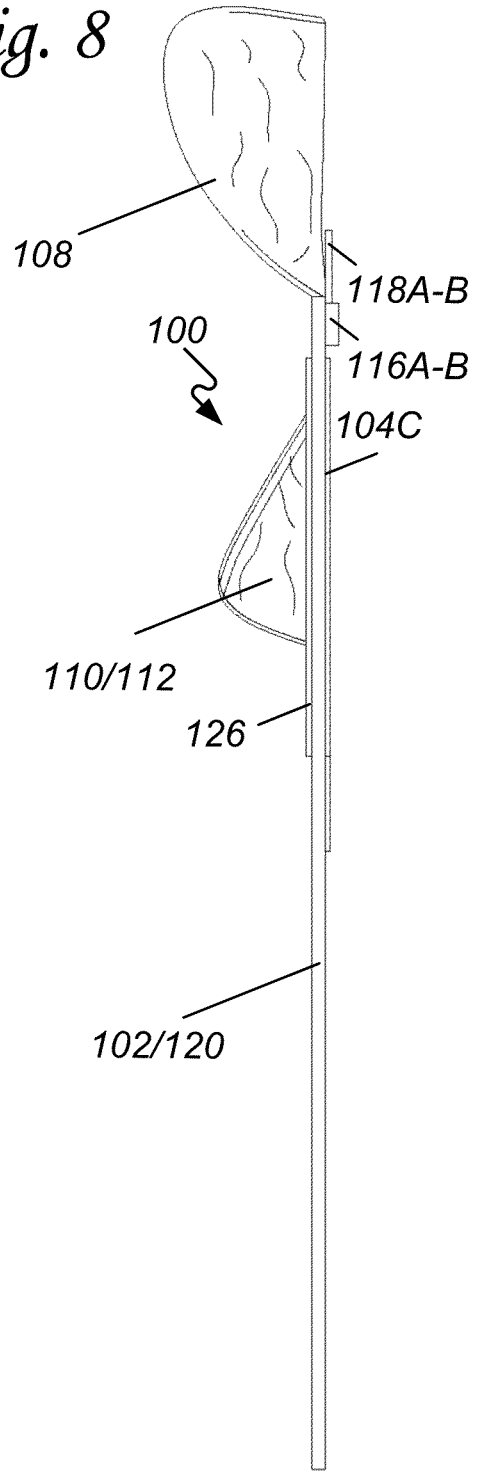

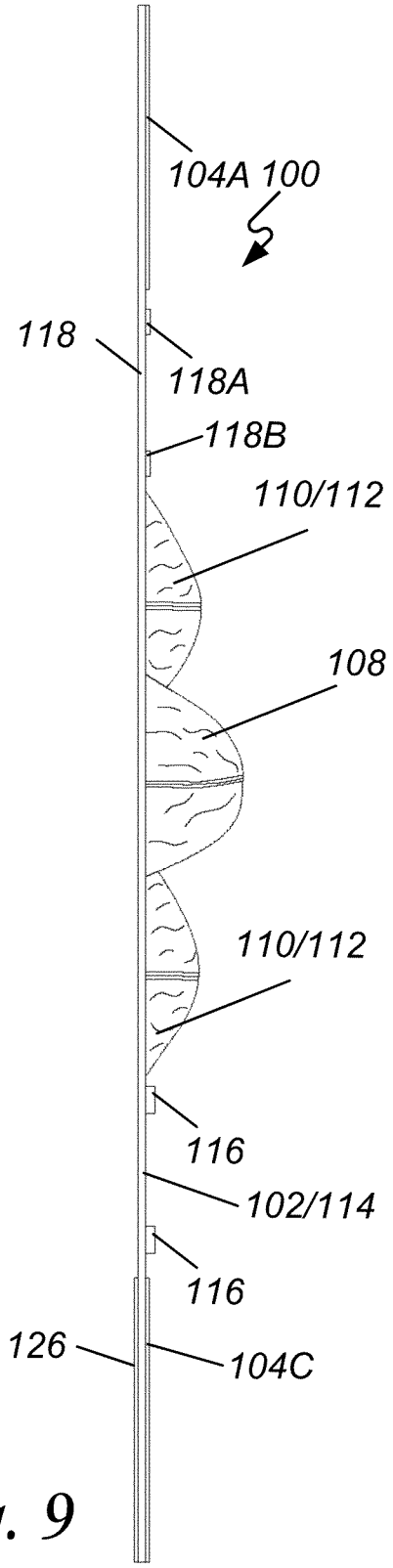
Fig. 9
Fig. 10
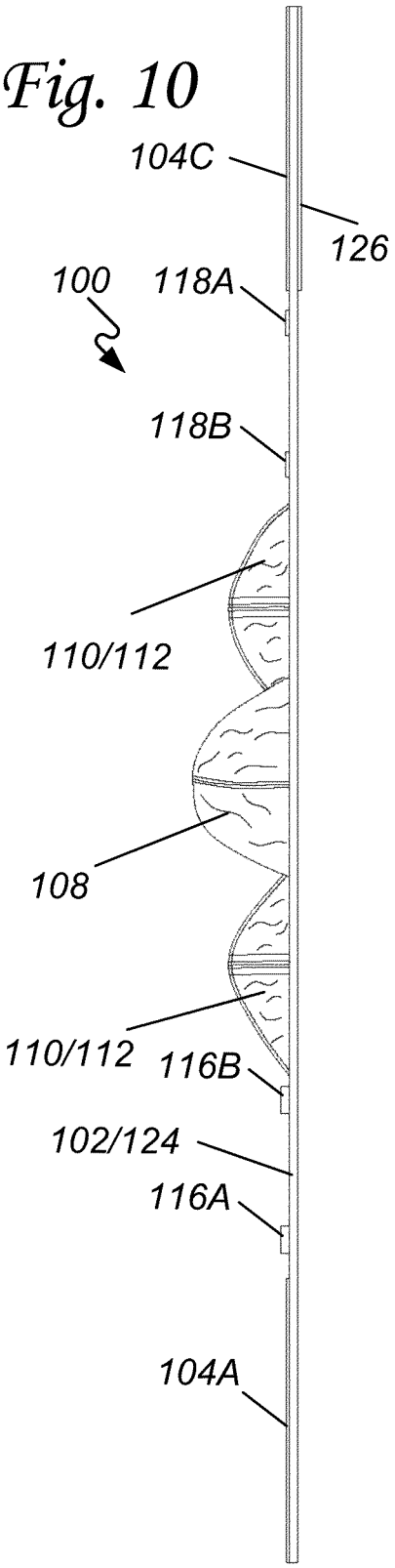

Fig. 11A
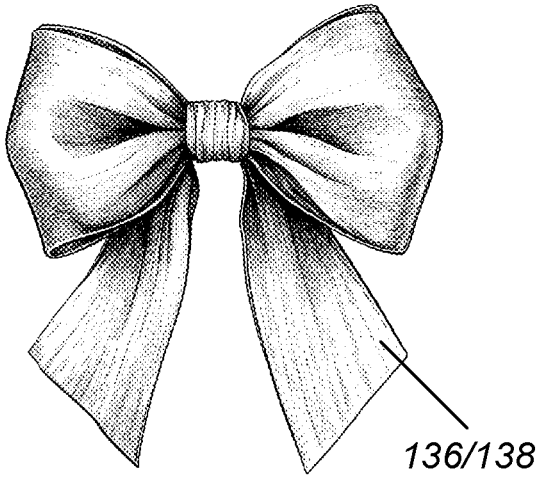
Fig. 11B
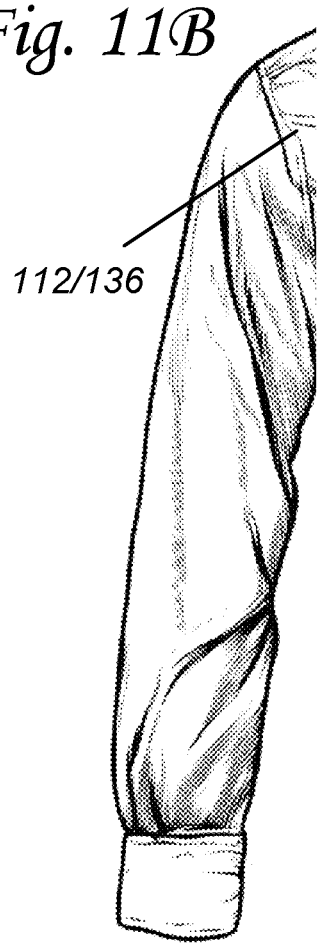
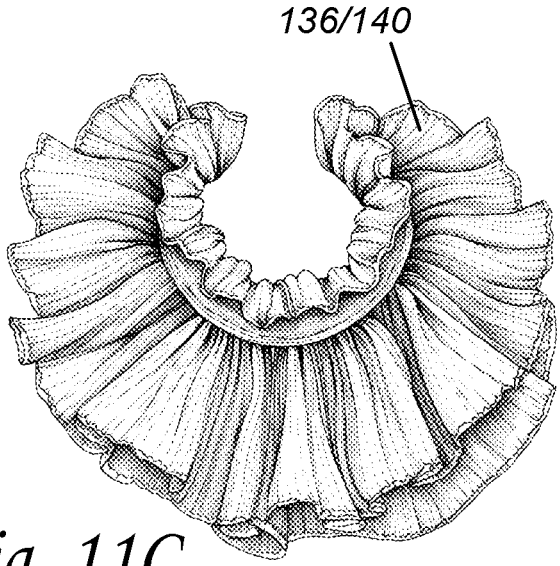
Fig. 11C
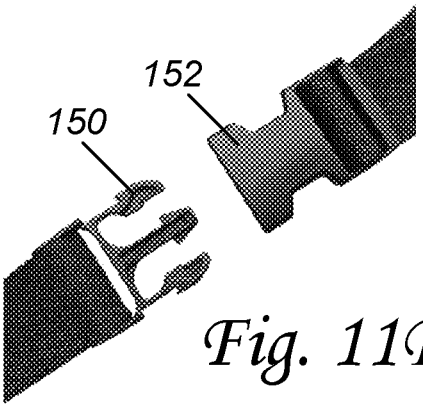
Fig. 11D
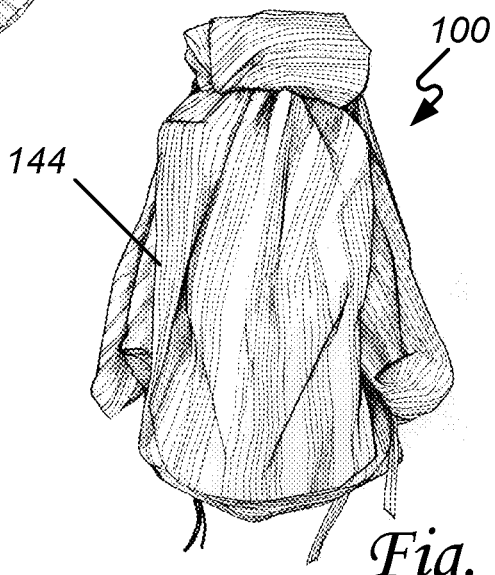
Fig. 11E

TRANSFORMABLE MODULAR GARMENT

CROSS-REFERENCE TO RELATED APPLICATIONS

This application contains subject matter which is related to the subject matter of the following co-pending applications. The below-listed applications are hereby incorporated herein by reference in its entirety:

This U.S. non-provisional application is a continuation in part of U.S. non-provisional application Ser. No. 18/813,390, inventor Tara Anderson et al., entitled "WEARABLE CABANA", filed Aug. 23, 2024; which claims the benefit of a U.S. provisional application, Ser. No. 63/553,174, inventor Tara Anderson et al., entitled "WEARABLE CABANA", filed Feb. 14, 2024.

TECHNICAL FIELD OF THE INVENTION

The present invention relates generally to wearable textile systems and, more particularly, to a transformable modular garment apparatus configured to be selectively arranged in multiple wearable states. The invention provides a textile-based structure incorporating detachable components, symmetrically aligned fasteners, and spatially oriented pockets that enable the garment to function as a wearable cape, towel, backpack, or torso-covering accessory. The invention is directed to applications involving beachwear, loungewear, or utility garments where reconfigurability, modularity, and compact storage are advantageous.

BACKGROUND OF THE INVENTION

Before our invention, wearable textile systems generally lacked structural configurability and spatial coherence across multiple modes of use. Garments that attempted to offer more than one wearable function were often burdened by compromises in fit, accessibility, modularity, or aesthetic balance. Their construction frequently involved static seams, non-removable components, or loosely placed fasteners that failed to enable meaningful reconfiguration by the user.

Functional limitations in earlier garments also extended to the inconsistent placement of storage elements. Pockets were often misaligned, unevenly distributed, or oriented in a way that rendered them inaccessible or ineffective when the garment was worn in alternative configurations. Additionally, fastener systems lacked spatial symmetry or positional structure, leading to discomfort, unsightly bunching, and unreliable closure performance.

Garments attempting multi-functional use often required manual folding or improvised fastening, which made the transformation process non-intuitive and prone to failure. These shortcomings prevented users from adapting the garment to suit changing environmental conditions, coverage preferences, or storage needs in a seamless and controlled manner.

There has been a persistent lack of wearable textile designs that integrate interchangeable components-such as sleeves, hoods, collars, and decorative elements-within a structurally balanced and spatially defined layout. There has also been no consistent solution to the challenge of aligning fasteners and pockets in a way that maintains functionality, appearance, and comfort across multiple garment states.

The present invention addresses these and other shortcomings by providing a structurally defined, transformable modular garment apparatus with interchangeable components and spatially aligned elements. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a transformable modular garment apparatus configurable for use in a towel configuration, a cape configuration, a backpack configuration, and a cover-up configuration. The garment includes a fabric body having defined exterior and interior surfaces, a neckline positioned along a top edge, and a pair of armholes located at opposing lateral edges. An interior pocket is mounted on the interior surface and oriented along a vertical center reference line, while three exterior pockets are mounted on the exterior surface—each with an open end also oriented toward the vertical center reference line and spaced from the neckline by defined margin distances. A cord loop fastener and a button fastener are symmetrically spaced from the lateral edges and configured to interconnect across the wearer's chest, thereby drawing the garment edges inward and reorienting the pocket openings toward one another to improve frontal accessibility in the wearable cape configuration.

Additional shortcomings of the prior art are overcome and additional advantages are provided through the provision of a transformable modular garment apparatus configurable for use in a towel configuration, a cape configuration, a backpack configuration, and a cover-up configuration. The apparatus includes a fabric body having a defined neckline along its top edge, lateral first and second edges, and armholes positioned at each lateral side. A pair of mesh exterior pockets are symmetrically mounted proximate to the lateral edges and spaced from the neckline by predetermined margin distances. Each pocket features an open end oriented toward a vertical center reference line to facilitate user access and debris escape. A plurality of fasteners are arranged proximate to the neckline and aligned laterally across the center reference line, allowing interconnection that draws the garment edges inward and repositions the pockets into a frontal orientation. The garment further includes a detachable hood and a pair of removable sleeves attachable at the armholes. The sleeves are configured to support no-shoulder, short-shoulder, or full-arm coverage arrangements. The structural alignment of components and fasteners enables deployment of the garment in cape, backpack, towel, and cover-up configurations without complex folding or reassembly.

Additional shortcomings of the prior art are overcome and additional advantages are provided through the provision of a transformable modular garment apparatus configurable for use in a towel configuration, a cape configuration, a backpack configuration, and a cover-up configuration. The garment includes a generally rectangular fabric body having a neckline along its top edge, a bottom edge of equal length positioned opposite the neckline, and equal-length first and second lateral edges. A pair of exterior pockets are mounted on the exterior surface proximate to the lateral edges and spaced from the neckline by defined margin distances. Each pocket has an open end oriented parallel to and facing toward a vertical center reference line extending from the midpoint of the neckline to the midpoint of the bottom edge. A pair of fasteners are spaced from the lateral edges and positioned proximate to the neckline to interconnect across the chest of a wearer, drawing the lateral edges inward and repositioning the pockets into a frontal configuration. The garment may be laid flat as a towel or selectively fastened along its perimeter edges to form a wearable backpack configuration.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 7 illustrates one example of a right side view of the wearable cabana;

FIG. 8 illustrates one example of a left side view of the wearable cabana;

FIG. 9 illustrates one example of a top view of the wearable cabana;

FIG. 10 illustrates one example of a bottom view of the wearable cabana; and FIGS. 11A-11E illustrate examples of accessory options for use with the wearable cabana.

Figure 1:
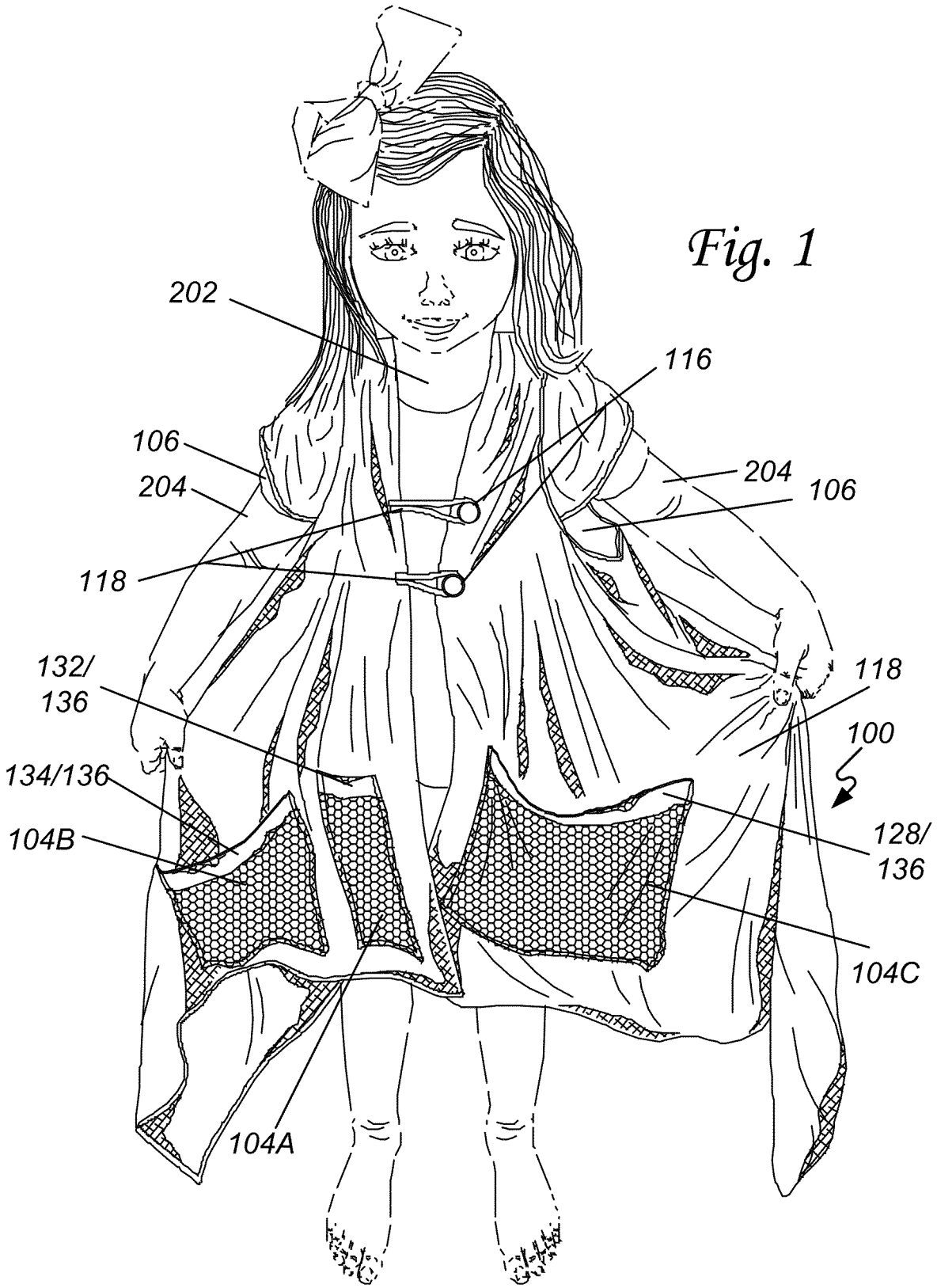
FIGS. 1-2 illustrates examples of a wearable cabana being modeled by a child.

The detailed description explains the preferred embodiments of the invention, together with advantages and features, by way of example with reference to the drawings.

DETAILED DESCRIPTION OF THE INVENTION

The following detailed description presents illustrative embodiments of a transformable modular garment apparatus that is structurally and spatially configured for use in multiple wearable modes, including a cape configuration, a towel configuration, a backpack configuration, and a cover-up configuration. The apparatus comprises a unibody fabric structure with integrated and attachable components arranged in defined spatial relationships, enabling the garment to be selectively configured based on user needs and environmental conditions without compromising functional balance or symmetry. The fabric body defines an exterior surface, an interior surface, a neckline along a top edge, opposed lateral edges, and armholes located near each lateral edge. The spatial geometry of the garment is further defined by a vertical center reference line and a horizontal center reference line, which serve as organizing axes for the placement and alignment of fasteners, pockets, and accessories.

Pockets positioned on both the interior and exterior surfaces are offset from the neckline by defined margin distances and have open ends oriented parallel to and facing the vertical center reference line. This arrangement enables the pocket openings to maintain accessibility and usability across multiple configurations. In wearable states where the garment wraps around the torso of the user, lateral fasteners positioned near the neckline and symmetrically spaced from the lateral edges can be interconnected across the chest to draw the edges inward. This action causes the pocket openings to reorient toward one another in a frontal position, enhancing visual symmetry and user access. Some pockets may be formed of mesh material to allow for visibility of contents and passage of sand, dirt, or debris, and may include angled orientations to support object retention during user movement.

Armholes are bordered by a circumferential array of fasteners configured to receive detachable sleeves. The sleeves may be short or long, each having a tubular body with a proximal opening configured to attach to the armhole in a secure but removable manner. This structure allows the garment to be selectively arranged in configurations with no shoulder covering, partial shoulder coverage, or full arm coverage, each offering a different user experience without altering the foundational layout of the fabric body. A hood is removably attachable along the contoured neckline edge using hook-and-loop fasteners, snaps, or other suitable means, allowing it to be added or removed based on weather or preference. A collar may also be attached along the neckline, contoured for ergonomic fit, and fabricated from thermally insulating or wind-resistant materials for enhanced comfort in colder settings.

A decorative bow or collar can be optionally attachable to the exterior surface of the fabric body at the intersection of the vertical and horizontal reference lines. This centered positioning enables the bow to serve as a visual focal point while concealing fasteners beneath it, preserving both aesthetic and functional balance. Fastener components positioned proximate to the neckline and adjacent to one or more exterior pockets may be configured to interconnect in mirrored alignment across the vertical center reference line, maintaining pocket spacing and chest symmetry when secured. The garment can be worn, laid flat, or folded and fastened into a compact form suitable for carrying, offering a high level of functional adaptability while preserving a clear structural framework.

Throughout this description, attention is given to spatial alignment, geometric proportionality, and component interchangeability to support a modular and reconfigurable textile apparatus. The invention provides a cohesive and user-friendly system that combines garment aesthetics with purposeful engineering, enabling practical wear, portability, and environmental adaptability through a uniquely structured and spatially defined configuration.

Figure 2:
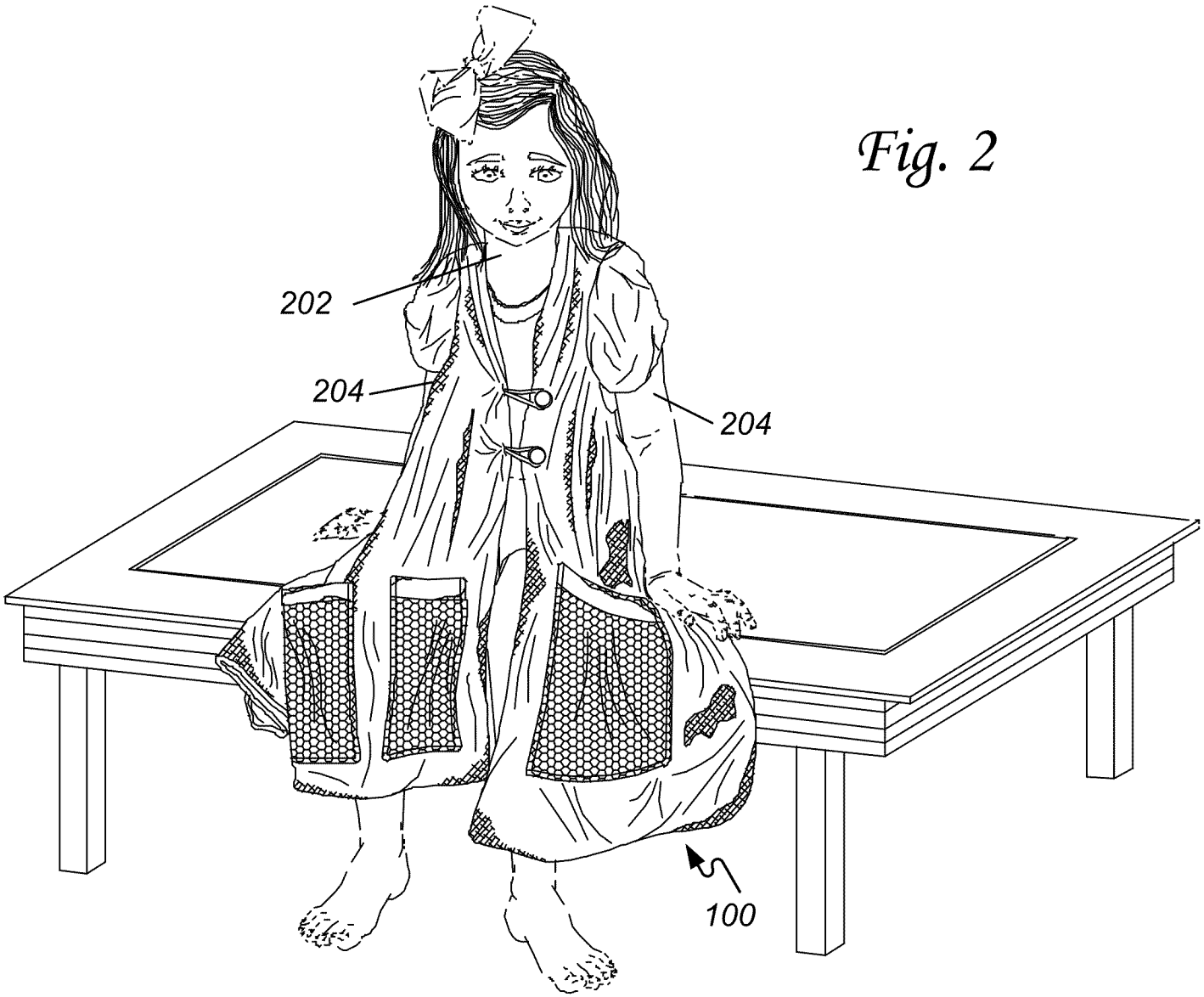

Turning now to the drawings in greater detail, it will be seen that in FIGS. 1 and 2, there is a wearable cabana 100 also referred to as a transformable modular garment 100 being modeled by a child 202, also referred to as a person 202 or wearer 202, standing in FIG. 1 and seated in FIG. 2. In an exemplary embodiment, when worn by wearer 202, the wearable cabana 100 drapes around the shoulders and across the back of wearer 202. The arms 204 of wearer 202 pass through armholes 106. Pockets 104A-C initially positioned horizontally parallel with the neckline 114 are reorientated vertically, perpendicular to the neckline 114 and accessible for use by wearer 202 by folding the left and right edges 120/122 over the shoulder of wearer 202 and orientating the pockets 104A-C parallel with the bottom edge 124, making the pockets 104A-C accessible for use by wearer 202.

The armholes 106 can include a ring of fasteners 136 disposed circumferentially around at least a portion of their perimeter. These fasteners 136 are configured to receive either short sleeves 110 or long sleeves 112. Each sleeve 110/112 includes a mating set of fasteners 136 along its proximal edge, enabling secure attachment that maintains rotational alignment relative to the armhole. The sleeves can be selectively arranged to achieve no-shoulder (no sleeve attached), short shoulder (short sleeve 110 attached), or full-arm coverage (long sleeve 112 attached) configurations.

In an exemplary embodiment. fasteners such as cord loops 118, buttons 116, and others can be positioned to secure the wearable cabana 100 across the chest of the child 202. The wearable cabana 100 can be made from a soft fabric 102, such as a soft towel fabric material, or other suitable materials.

The cord loops 118 and buttons 116 are spaced from their respective lateral edges by equivalent fastener distances, establishing a symmetrical closure system about the vertical center reference line 338. This symmetry is further extended by optional secondary fasteners placed at uniform spacings below the neckline to form a second closure point, enhancing garment stability and frontal alignment of the pockets when worn.

In an exemplary embodiment, the soft towel fabric 102 can be cotton, polyester, micro-fiber, other fabrics, water resistant, wind resistant, insulated, sweat-wicking, a combination thereof, or other types or kinds of materials, as may be required and/or desired in a particular embodiment.

For applications where protection from the sun's harmful ultraviolet (UV) rays is required, the soft fabric 102 selected for use can have a sun protection factor (SPF) rating of at least 25, preferably 50 or higher. In this regard, one application of the wearable cabana 100 can be as a cover-up to protect wearer 202 from sunburn or too much sun exposure. Other cover-up applications can include, without limitation, a windbreaker, cold temperatures, rainy weather, or other inclement weather.

In an exemplary embodiment, the aesthetic design of the wearable cabana 100 can vary too, including colors, prints and images, color, markings, and reflective elements for safety.

In another application, when the wearable cabana 100 is not being worn by wearer 202, it can be used as a towel and/or to dry wearer 202 from water, sports, sweat, or other activities.

Figure 3:
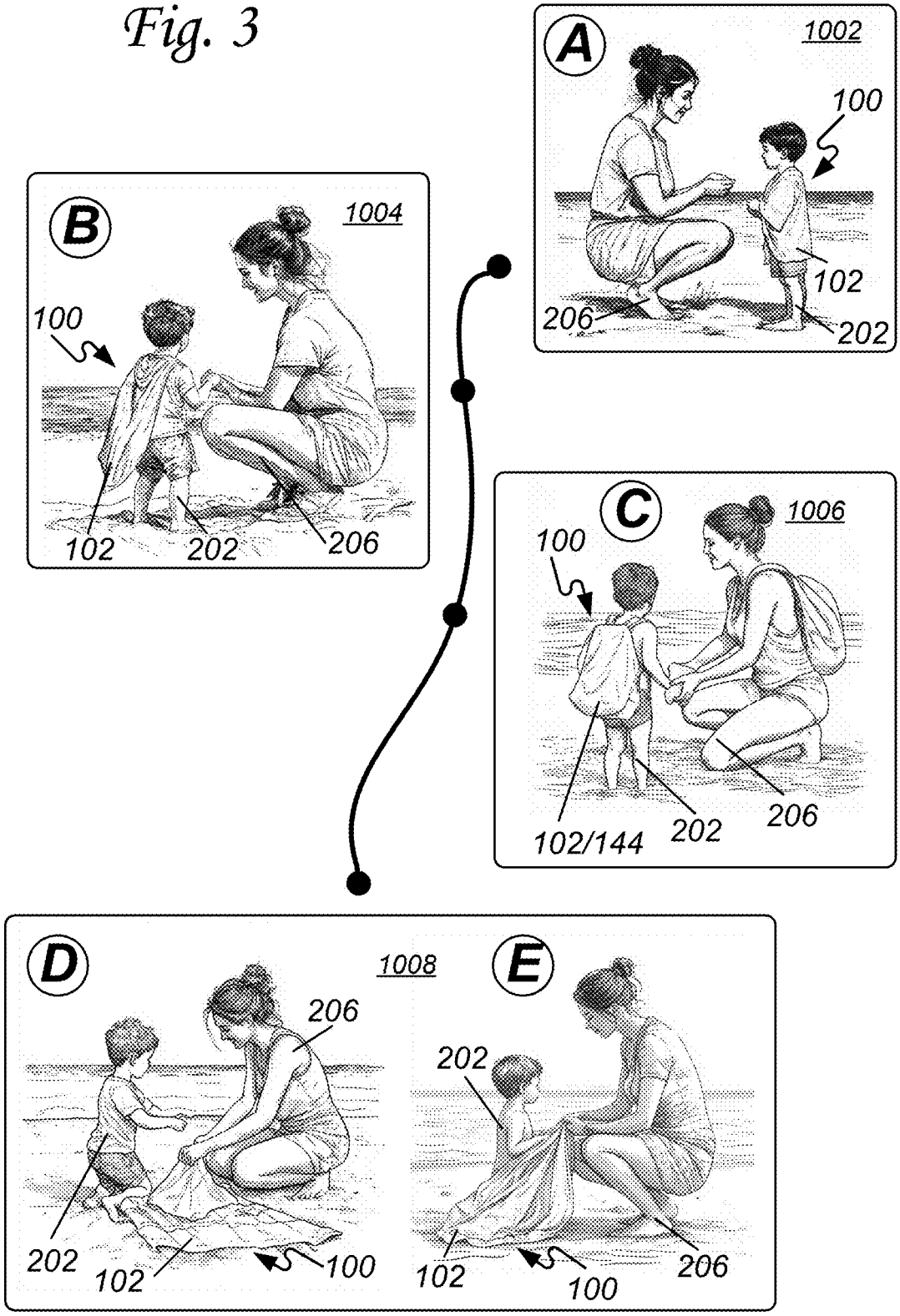
FIG. 3 illustrates methods of using the wearable cabana as a cover-up, a cape, a bag or a backpack, or a towel.

Referring to FIG. 3, there are illustrated methods of using the wearable cabana 100 as a cover-up, a cape, a bag or a backpack, or a towel. In an exemplary embodiment, in reference 'A', step 1002, the wearable cabana 100 can be transitioned into a cover-up when the soft fabric 102 is wrapped around the torso of wearer 202. Such can be accomplished if needed with the assistance of a caregiver 206.

Figure 5:
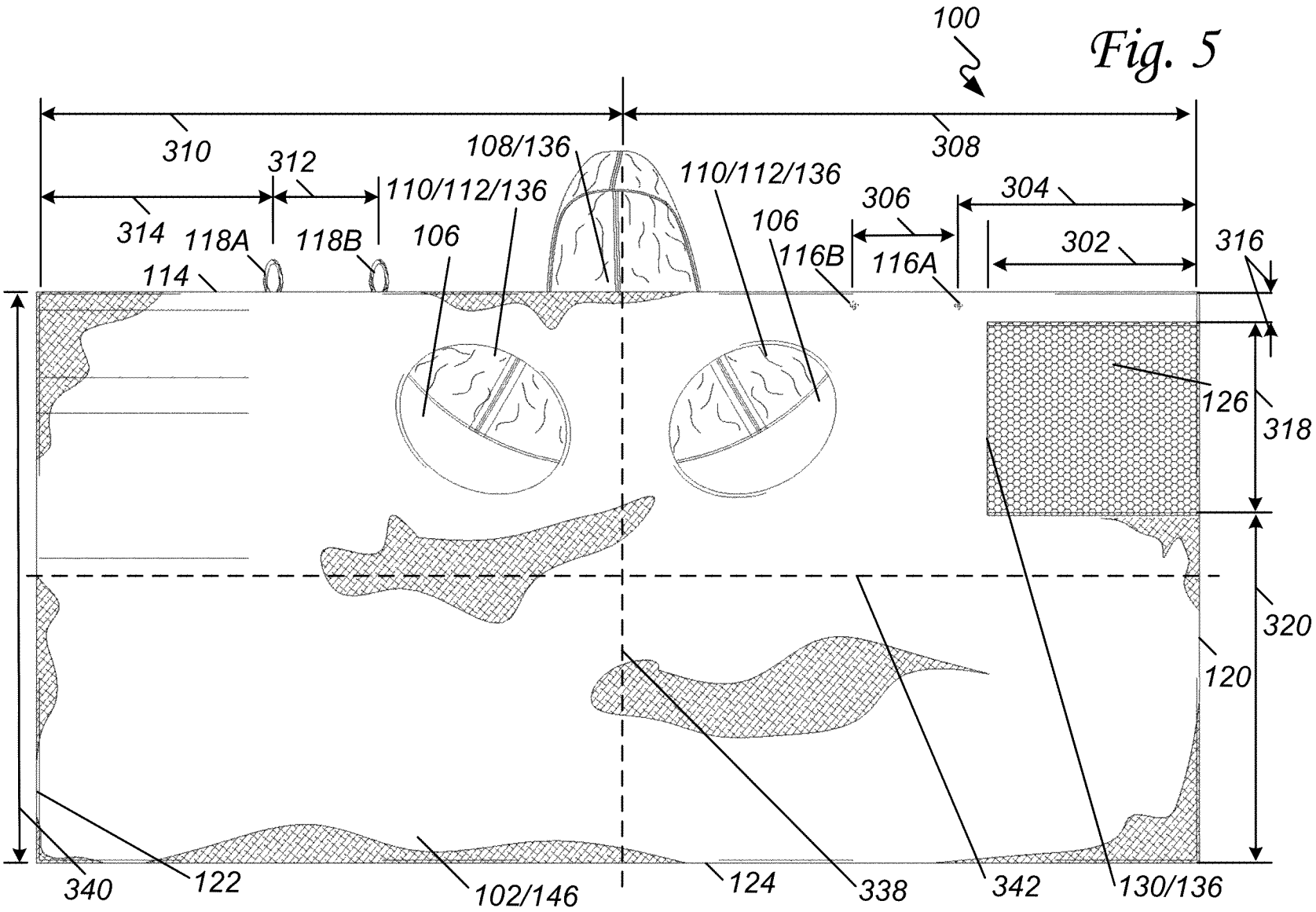
FIG. 5 illustrates one example of the interior surface of the wearable cabana.

In an exemplary embodiment, and with reference to at least FIGS. 5 and 11, shoulder cover 110 or sleeve 112 can be attached to the arm moles 106 in a permanent such as sewn, or in a removable manner, such as hook and loop or other suitable method. In this regard, short shoulder 110 covering or long sleeve 112 arm covers can be optionally selected, and in embodiments where they are attached, in a removable manner, configured or otherwise swapped when needed, and based on personal need or preference.

In an exemplary embodiment, different sizes of soft fabric 102 can be used so that the cover-up configuration reaches the belt line, top portion of the legs, knees, or other desired length. Additionally, the soft fabric 102 can have an exterior surface 148 better illustrated in at least FIG. 6, an interior surface 146 better illustrated in at least FIG. 5, a neckline 114, a bottom edge 124, a first edge 120, a second edge 122, and an armhole 106 on each side of a vertical center reference line 338. The soft fabric 120 can be cut into a rectangular shape such that neckline 114 and bottom edge 124 are the same length and greater in length than the first edge 120 and the second edge 122. The first edge 120 and the second edge 122 are the same length. The interior surface 146 is in contact with wearer 202 when worn.

The fabric body 102 defines a structured planar layout with a central vertical center reference line 338 and a horizontal center reference line 342. These reference lines serve as spatial axes for symmetrically arranging armholes, pockets, fasteners, and other components, thereby supporting modularity and balanced wear configurations.

In an exemplary embodiment, the vertical center reference line 338 is equidistant between 308 and 310, bisecting the middle of neckline 114 and bottom edge 124. A horizontal center reference line 342 bisects the middle of the first edge 120 and the second edge 122 also referred to as the right edge 120 and the left edge 122.

For disclosure purposes, the first edge can be a right or left edge, and the second edge is the opposite of the first edge. The first edge and the second edge 120/122 can also be referred to as the right and left edges 120/122, and vice versa.

In another alternative use of the wearable cabana 100, in reference 'B', step 1004, the wearable cabana 100 can be transitioned into a cape when the neckline 114 is wrapped around the back of the neck of the wearer 202 and at least one of the first fastener 116 and at least one of the second fastener 118 that is proximate to the neckline 114 are interconnected.

In another alternative use of the wearable cabana 100, in reference 'C', step 1006, the wearable cabana 100 can be transitioned into a bag or a backpack 144 that can be carried or worn by wearer 202 when the perimeter edges of the soft fabric 102 are fastened together in a removable manner.

In another alternative use of the wearable cabana 100, in reference 'D', step 1006, the wearable cabana 100 can be transitioned into a towel when the soft fabric 102 is removed from wearer 202 and laid flat on a surface or used, in reference 'E' to dry off wearer 202.

Figure 4A:
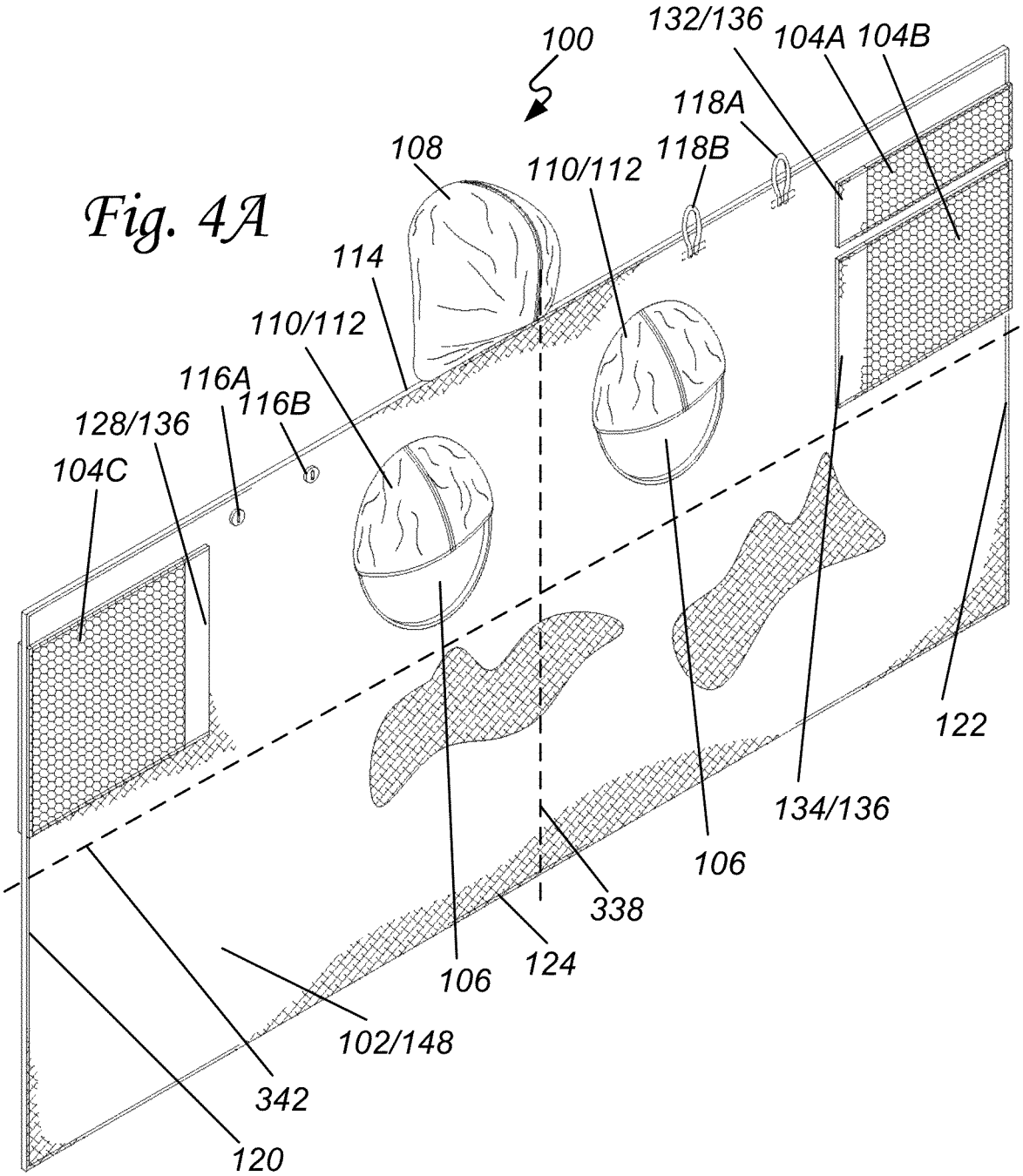
FIGS. 4A-4C illustrate examples of perspective views of the exterior surface of the wearable cabana.
Figure 6:
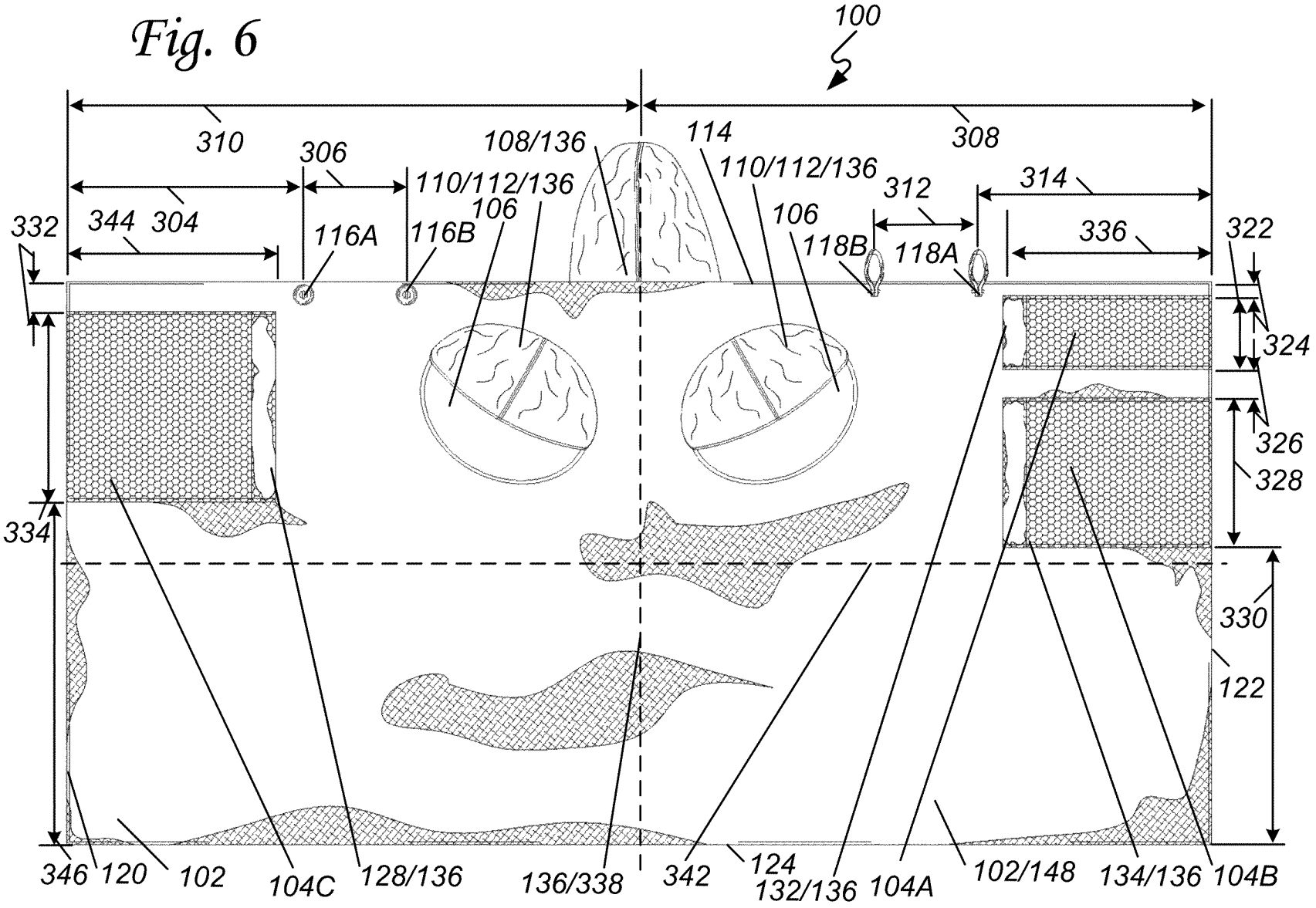
FIG. 6 illustrates one example of the exterior surface of the wearable cabana.

Referring to FIG. 4A, there is illustrated one example of a perspective view of the exterior surface 148 of the wearable cabana 100. Referring to FIG. 5, there is illustrated one example of the interior surface 146 (or back view) of the wearable cabana 100. Referring to FIG. 6, there is illustrated one example of the exterior surface 148 (or front view) of the wearable cabana 100.

In an exemplary embodiment, a wearable cabana 100 can comprise a fabric that has an exterior surface 148, an interior surface 146, a neckline 114, a first edge 120, a second edge 122, and an armhole 106 on each side of a vertical center reference line 338. The interior surface 146 is in contact with wearer 202 when the wearable cabana 100 is worn. The vertical center reference line 338 bisects the middle of the neckline 114 and the middle of the bottom edge 124.

In an exemplary embodiment, the neckline 114 and the bottom edge 124 are the same length and greater in length than the first edge 120 and the second edge 122. The first edge 120 and the second edge 122 are the same length 340.

A shoulder cover 110 or sleeve 112 can be fastened along at least a portion of each of the armhole 106 and configured to cover when worn by wearer 202, at least the shoulder of person 202 if the shoulder cover 110 is used or the arm of the person including the shoulder if the sleeve 112 is used. The shoulder cover 110 and the sleeve 112 can be affixed in a permanent way such as by sewing or other suitable ways or can be attached, in a removable manner, such as by hook and loop, snaps, or other suitable ways.

An interior pocket 126 can be attached to the interior surface 146 along either the first edge 120 or the second edge 122, a first margin distance 316 from the neckline 114 with an interior pocket open end 130 that is oriented to face and be parallel to the vertical center reference line 338.

The interior pocket 126 is positioned along the interior surface of the fabric body 102 proximate to either the first or second edge 120/122, with an open end aligned parallel to the vertical center reference line 338. The third exterior pocket 104B is laterally adjacent to the second exterior pocket 104A and is oriented downward at an angle, providing gravity-assisted object retention. Its open end also faces the vertical center reference line 338, creating uniformity in user-facing pocket access.

In an exemplary embodiment, the interior pocket open end 130 can be opened or fastened closed by a fastener 136, such as a hook and loop, magnet, button, snap, zipper, or other suitable fasteners, as may be required and/or desired in a particular embodiment.

In an exemplary embodiment, the interior pocket 126 can be fabricated from a mesh material so that objects in the pocket can be viewed more easily and sand or dirt such as from the beach or other debris can escape the interior pocket 126 through the mesh material. In other embodiments, the interior pocket 126 can be fabricated from other suitable materials including insulated materials that can be useful in keeping for example a drink, snack, or other items cool, dry, and clean, as may be required and/or desired in a particular embodiment.

The first margin distance 316 can be in the range of less than 7 inches and preferrable less than 3 inches from the neckline 114. This keeps the interior pocket 126 sufficiently close to the neckline 114 so that when worn by wearer 202 the wearable cabana 100, second edge 122 folds downward over the shoulder of wearer 202 reorientating the interior pocket open end 130 to be parallel with the neckline 114, perpendicular to the reference center line 338, making the interior pocket 126 accessible and useable by wearer 202.

In an exemplary embodiment, the interior pocket 126 can have a width 318, a length 302, and be located with a closed edge along the second edge 122 and a distance 320 from the bottom edge 124.

In an exemplary embodiment, the interior pocket 126 can be located proximate to either the first edge 120, the second edge 122, or both if two interior pockets are desired, and between the neckline 114 and the horizontal center reference line 342.

A first exterior pocket 104C can be attached on the exterior surface 148 proximate to the first edge 120, a second margin distance 332 from the neckline 114. The first exterior pocket 104C can comprise a first exterior pocket open end 128 that is oriented to face and be parallel to the vertical center reference line 338.

In an exemplary embodiment, the first exterior pocket 104C can be fabricated from a mesh material so that objects in the pocket can be viewed more easily, and sand or dirt, such as from the beach or other debris, can escape the first exterior pocket 104C through the mesh material. In other embodiments, the first exterior pocket 104C can be fabricated from other suitable materials, including insulated materials that can be useful in keeping, for example, a drink, snack, or other items cool, dry, and clean, as may be required and/or desired in a particular embodiment.

The second margin distance 332 can be in the range of less than 7 inches and preferrable less than 3 inches from the neckline 114. This keeps the first exterior pocket 104C sufficiently close to the neckline 114 so that when worn by wearer 202 the wearable cabana 100, first edge 120 folds downward over the shoulder of wearer 202 reorientating the first exterior pocket open end 128 to be parallel with the neckline 114, perpendicular to the reference center line 338, making the first exterior pocket 104C accessible and useable by wearer 202.

The first exterior pocket 104C can have a width 334, a length 344, and be located with a closed edge along the first edge 120, a distance 346 from the bottom edge 124.

A second exterior pocket 104A can be attached on the exterior surface 148 proximate to the second edge 122, a third margin distance 324 from the neckline 114. The second exterior pocket 104A can comprise a second exterior pocket open end 132 that is oriented to face and be parallel to the vertical center reference line 338.

Each of the first exterior pocket 104C and second exterior pocket 104A can be oriented such that its open end faces toward the vertical center reference line 338. This positioning ensures that, when the garment is worn and fasteners are interconnected across the chest, the pockets rotate inward into a frontal orientation for user access. The symmetrical offset from the neckline provides margin distances that contribute to balanced appearance and functional alignment.

In an exemplary embodiment, the second exterior pocket 104A can be fabricated from a mesh material so that objects in the pocket can be viewed more easily and sand or dirt, such as from the beach or other debris, can escape the second exterior pocket 104A through the mesh material. In other embodiments, the second exterior pocket 104A can be fabricated from other suitable materials, including insulated materials that can be useful in keeping, for example, a drink, snack, or other items cool, dry, and clean, as may be required and/or desired in a particular embodiment.

The third margin distance 324 can be in the range of less than 7 inches and preferrable less than 3 inches from the neckline 114. This keeps the second exterior pocket 104A sufficiently close to the neckline 114 so that when worn by wearer 202 the wearable cabana 100, second edge 122 folds downward over the shoulder of wearer 202 reorientating the second exterior pocket open end 132 to be parallel with the neckline 114, perpendicular to the vertical center reference line 338, making the second exterior pocket 104A accessible and useable by wearer 202.

In an exemplary embodiment, the second exterior pocket 104A can have a width 322, a length 336, and be located with a closed edge along the second edge 122.

In an exemplary embodiment, the second exterior pocket 402C can be located between the neckline 114 and the horizontal center reference line 342.

A third exterior pocket 104B can be attached to the exterior surface 148 adjacent to and separated by a fourth margin distance 326 from the second exterior pocket 104A. The third exterior pocket 104B can comprise a third exterior pocket open end 134 that is oriented to face the vertical center reference line 338.

In an exemplary embodiment, the fourth margin distance 326 is preferable in the range of less than 3 inches, but can be other ranges as may be required and or desired in a particular embodiment.

In an exemplary embodiment, the width 322 of the second exterior pocket 104A can be one-half or less than the width 328 of the third exterior pocket 104B. In this regard, the narrower width 322 of the second exterior pocket 104A allows objects such as sunglasses and other objects that are narrow and long to be more easily stored and retrieved from the second exterior pocket 104A. Additionally, the narrower width 322 of the second exterior pocket 104A in combination with the wider width 328 of the third exterior pocket 104B allows both pockets to be positioned between the neckline 114 and the horizontal center reference line 342. This positioning allows both the second and third exterior pockets 104A-B to be easily accessible proximate to the front surface of the torso of wearer 202 when wearing the wearable cabana 100.

In an exemplary embodiment, the third exterior pocket 104B can be fabricated from a mesh material so that objects in the pocket can be viewed more easily and sand or dirt, such as from the beach or other debris, can escape the third exterior pocket 104B through the mesh material. In other embodiments, the third exterior pocket 104B can be fabricated from other suitable materials, including insulated materials that can be useful in keeping, for example, a drink, snack, or other items cool, dry, and clean, as may be required and/or desired in a particular embodiment.

The fourth margin distance 326 can be in the range of less than 7 inches and preferrable less than 3 inches from the edge of the second exterior pocket 104A. This keeps the third exterior pocket 104B sufficiently close to the neckline 114 and the second exterior pocket 104A so that when worn by wearer 202 the wearable cabana 100, second edge 122 folds downward over the shoulder of wearer 202 reorientating the third exterior pocket open end 134 to be parallel with the neckline 114, perpendicular to the vertical center reference line 338, making the third exterior pocket 104B accessible and useable by wearer 202.

In an exemplary embodiment, the third exterior pocket 104B can have a width 328, a length 336, and be located with a closed edge along the second edge 122.

In an exemplary embodiment, the third exterior pocket 104B can be located between the neckline 114 and the horizontal center reference line 342.

In a plurality of exemplary embodiments, each of the pockets 104A-C and 126 can be configured differently. In this regard, some pockets can be fabricated with mesh material, some insulated, and some configured in other suitable ways. Additionally, the pocket open ends 128/130/132/134 can use different methods to be opened or fastened closed such as a hook and loop, magnet, button, snap, zipper, or other suitable fasteners depending on the configuration of the specific pocket purpose, as may be required and/or desired in a particular embodiment.

Figure 4B:
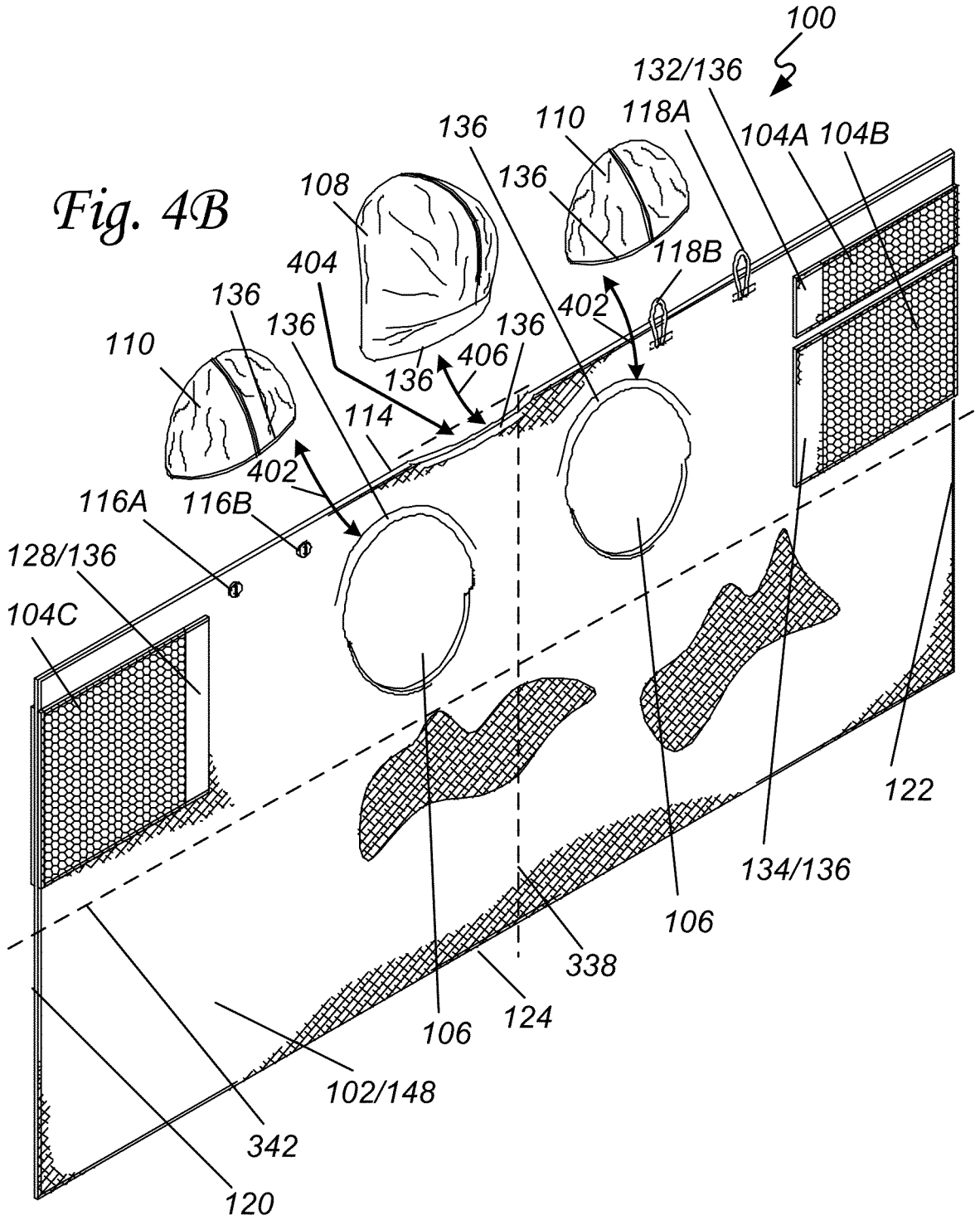

Referring to FIG. 4B, there is illustrated a perspective assembly view of the exterior surface of the wearable cabana, showing the fabric body 102 in an unassembled state to better illustrate the spatial and modular relationships of key components. The fabric body 102 comprises an exterior surface, an interior surface, and a neckline 114 located centrally along a top edge. A first edge and a second edge extend laterally from the vertical centerline, while armholes 106 are positioned along each lateral edge of the fabric body 102, equidistant from the neckline and aligned across the vertical center reference line 338. This vertical center reference line 338 bisects the garment longitudinally and serves as a consistent reference for symmetrical component placement.

Surrounding each armhole 106 is a set of fasteners 136 disposed circumferentially along the periphery of each armhole. These fasteners 136 are configured to securely receive short sleeves 110, which are shown in a detached position in FIG. 4B. Each sleeve 110 is positioned laterally outside its corresponding armhole 106, and motion arrows 402 indicate the direction of engagement. The spatial relationship between the sleeves 110 and the armholes 106 ensures modular compatibility and enables selective attachment for different coverage modes, including no-shoulder, short shoulder, and full arm configurations. The sleeves 110 are designed to align with the horizontal center reference line 342, providing a consistent baseline across the midsection of the garment when worn.

Also depicted in FIG. 4B is a detached hood 108, positioned above the fabric body 102. The hood 108 is oriented to attach proximate to the neckline 114 using hook-and-loop fasteners, snaps, or other removable attachment mechanisms. A motion arrow 406 illustrates the attachment path from the hood 108 toward the neckline 114. Notably, the neckline 114 includes a contoured neckline region 404, which is shaped to match the curvature of the hood's base edge. This contoured profile facilitates secure alignment and ergonomic integration when the hood 108 is attached, forming a complete upper opening around the back and sides of the wearer's 202 neck.

In operation, the hood 108 can be detachably mounted proximate to the neckline 114 and aligned along a contoured neckline edge 404. The contoured shape ensures ergonomic fit around the back of the neck and upper shoulders and provides a stable interface for fastening using hook-and-loop fasteners, snaps, or other suitable fasteners 136. This structure supports removable hood configurations without bulk or bunching.

The spatial configuration of FIG. 4B highlights how each modular element-sleeves, hood, and fasteners—is aligned in relation to the vertical and horizontal reference lines. These reference lines function as spatial axes around which the component placement is symmetrically mirrored, ensuring that the garment can be worn with balanced pocket alignment, uniform fastener distribution, and comfortable anatomical fit.

Figure 4C:
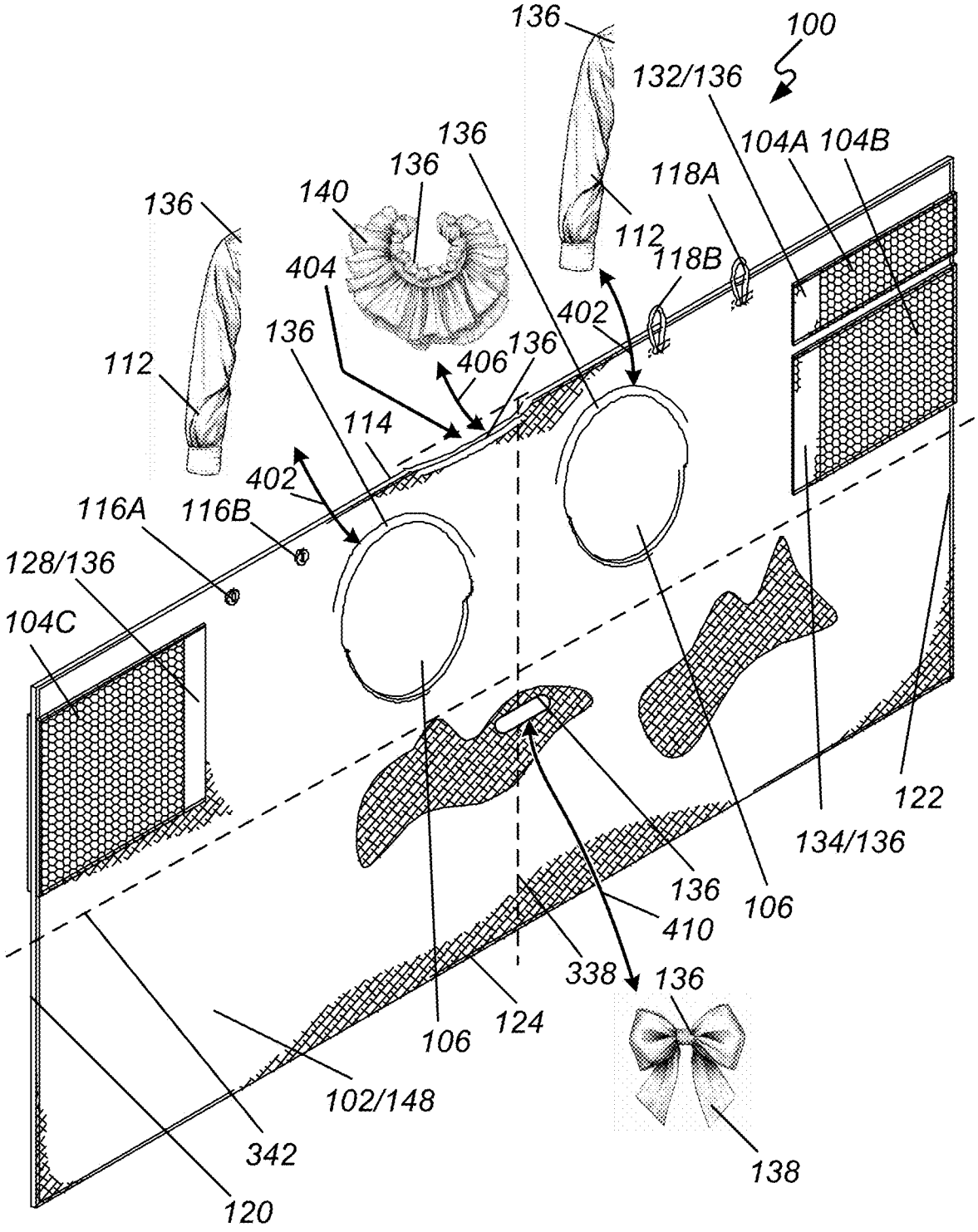

Referring to FIG. 4C, there is illustrated a second assembly perspective view of the exterior surface of the wearable cabana, showing alternative components that can be used in place of those shown in FIG. 4B. Specifically, long full arm coverage sleeves 112 are shown in a detached configuration, each aligned laterally with a corresponding armhole 106 on the fabric body 102. Motion arrows 402 indicate the path of attachment to the armholes using fasteners 136, which are symmetrically distributed around the circumference of each opening. These longer sleeves extend the coverage area downward from the shoulder to the wrist region of the wearer, and are selectively attachable to replace the short sleeves 110, depending on the desired coverage and environmental conditions.

Positioned above the neckline 114 is a detachable collar 140, shown in a removed state with motion arrow 406 illustrating the direction of attachment. The collar 140 is dimensioned to span laterally across the neckline region and includes a contoured inner edge that aligns with the neckline 114 when secured. The outer edge of collar 140 is designed to extend upward and rearward to partially encircle the wearer's neck in the cape configuration, providing additional insulation or wind protection. The collar 140 may be fabricated from thermally insulating or wind-resistant material and includes removable fastening mechanisms allowing it to be easily added or removed as needed. Its placement along the top center of the garment maintains a spatial alignment centered on the vertical center reference line 338.

In operation, the collar 140 is selectively attachable along the neckline 114 and includes a contoured inner edge to match the shape of the neckline 114. Its outer edge extends upward and rearward to partially enclose the neck region. The collar is fabricated from thermally insulating or wind-resistant material to enhance the utility of the garment in colder climates, and its removability allows the garment to be configured for either cold- or warm-weather use.

A Iso visible in FIG. 4C is a decorative bow 138, shown in a detached position. A motion arrow 410 indicates the direction and location of attachment, which is positioned at the intersection of the vertical center reference line 338 and horizontal center reference line 342. A fastener 136 is visible at the attachment point to receive the bow 138. This placement positions the bow at the geometric center of the exterior surface of the fabric body 102 when worn in the cape configuration, concealing the aligned fasteners and providing a central, symmetrical aesthetic element. The use of the bow in this location is consistent with the spatial architecture of the garment and reinforces the structured modularity of the overall system.

In operation, the bow 138 can be positioned at the intersection of the vertical center reference line 338 and the horizontal center reference line 342. This spatial alignment allows the bow to serve both as a decorative focal point and as a concealment feature for fasteners 136 located. The centered placement enhances symmetry and aesthetic balance when worn.

FIG. 4C emphasizes how the removable components—including the long sleeves, collar, and bow—are each located relative to defined geometric reference lines that extend across the garment's surface. The spatial symmetry and relative positioning of these elements contribute not only to the garment's functionality across multiple wear configurations (cape, towel, backpack, cover-up) but also to the ease with which users can reconfigure the garment to suit variable environmental conditions, coverage preferences, and user aesthetic selections.

With reference to at least FIG. 6, at least one cord loop 118A can be attached proximate to the neckline 114 a first fastener distance 314 from the second edge 122. In addition, At least one button 116A can be attached proximate to the neckline 114, a second fastener distance 304 from the first edge 120.

In an exemplary embodiment, a third fastener 118B, such as a cord loop or other suitable fastener, can be attached proximate to the neckline 114 adjacent to the first fastener 118A, such as a cord loop 118A, and separated by a third fastener distance 312. In addition, a fourth fastener 116B, such as a button or other suitable fastener, can be attached proximate to the neckline 114 adjacent to the second fastener 116A, such as button 116A, and separated by a fourth fastener distance 306. In operation, the first fastener distance 336 and the second fastener distance 304 can be equal, and the third fastener distance 312 and the fourth fastener distance 306 can be equal, such that the fasteners 118A-B and 116A-B align and are proximate when the wearable cabana 100 is worn by wearer 202.

In an exemplary embodiment, fabric 102 can be sized to drape across the back of wearer 202 with arms 204 of wearer 202 being placed through armholes 106. The cord loops 118A-B and buttons 116A-B align and interconnect securing the fabric 102 across the chest of wearer 202 which reorientates the interior pocket open end 130, the first exterior pocket open end 128, the second exterior pocket open end 132, and the third exterior pocket open end 134 perpendicular to the vertical center reference line 338, making the interior pocket 126, the first exterior pocket 104C, the second exterior pocket 104A, and the third exterior pocket 104B accessible and useable to wearer 202.

In an exemplary embodiment, a hood 108 can be attached in a permanent manner, such as by sewing or another suitable method, or in a removable manner, such as by hook and loop, snaps, or another suitable method to the neckline 114 between and centered with respect to the vertical center reference line 338.

In an exemplary embodiment, the shoulder cover 116 can be configured as a sleeve 118 that extends along the length of arm 204 of wearer 202.

Referring to FIG. 7, there is illustrated one example of a right side view of the wearable cabana 100. Referring to FIG. 8, there is illustrated one example of a left side view of the wearable cabana 100.

In an exemplary embodiment, a wearable cabana 100 can comprise a fabric 102 that has an exterior surface 148, an interior surface 146, a neckline 114, a bottom edge 124, a first edge 120, a second edge 122, and an armhole 106 on each side of a vertical center reference line 338. The fabric 102 can be cut into a rectangular shape. The neckline 114 and the bottom edge 124 can be the same length and greater in length than the first edge 120 and the second edge 122. The first edge 120 and the second edge 122 can be the same length. The interior surface 146 is in contact with a wearer 202 when the wearable cabana 100 is worn.

A first exterior pocket 104C can be attached on the exterior surface 148 proximate to the first edge 120, a first margin distance 322 from neckline 114. The first exterior pocket 104C can comprise a first exterior pocket open end 128 that can be orientated to face and be parallel to a vertical center reference line 338, the vertical center reference line 338 bisects the middle of neckline 114 and the middle of the bottom edge 124.

A second exterior pocket 104A can be attached on the exterior surface 148 proximate to the second edge 122, a second margin distance 324 from the neckline 114. The second exterior pocket 104A can comprise a second exterior pocket open end 132 that can be oriented to face and be parallel to the vertical center reference line 338. The first exterior pocket 104C and the second exterior pocket 104A are positioned between the neckline 114 and a horizontal center reference line 342. The horizontal center reference line 342 bisects the middle of the first edge 120 and the second edge 122, also referred to as the right edge 120 and the left edge 122.

At least one first fastener 118A can be attached proximate to neckline 114, a first fastener distance 314 from the second edge 122. At least one second fastener 116A can be attached proximate to neckline 114, a second fastener distance 304 from the first edge 120.

The wearable cabana 100 can be used as a cover-up (see at least FIG. 3, reference 'A') when the fabric 102 is wrapped around the torso of the person, a cape (se at least FIG. 3, reference 'B') when the neckline 114 is wrapped around the back of the neck of the wearer 202 and at least one of the first fastener 118A and at least one of the second fastener 116A that are proximate to the neckline 114 are interconnected, a bag or a backpack 144 that can be carried or worn by the wearer 202 (see at least FIG. 3, reference 'C') when the perimeter edges of the fabric are fastened together in a removable manner, or a towel (see at least FIG. 3, reference 'D') when the fabric 102 is removed from the wearer 202 and laid flat on a surface or used to dry off the person (see at least FIG. 3, reference 'E').

Referring to FIG. 9, there is illustrated one example of a top view of the wearable cabana 100. Referring to FIG. 10, there is illustrated one example of a bottom view of the wearable cabana 100.

In an exemplary embodiment, a wearable cabana 100 can comprise a fabric 102 that has an exterior surface 148, an interior surface 146, a neckline 114, a first edge 120, a second edge 122, and an armhole 106 on each side of a vertical center reference line 338. The interior surface 146 is in contact with wearer 202 when the wearable cabana 100 is worn.

A first exterior pocket 104C can be attached on the exterior surface 148 proximate to the first edge 120, a first margin distance 332 from the neckline 114. The first exterior pocket 104C can comprise a first exterior pocket open end 128 that is oriented to face and be parallel to the vertical center reference line 338.

A second exterior pocket 104A can be attached on the exterior surface 148 proximate to the second edge 122, a second margin distance 322 from the neckline 114. The second exterior pocket 104A can comprise a second exterior pocket open end 132 that is oriented to face and be parallel to the vertical center reference line 338.

At least one first fastener 118A can be attached proximate to neckline 114, a first fastener distance 314 from the second edge 122. Additionally, at least one second fastener 116A can be attached proximate to neckline 114, a second fastener distance 304 from the first edge 120.

Fabric 102 can be sized to drape across the back of wearer 202, with the arms 204 of wearer 202 being placed through the armhole 106. The first fastener 118A and the second fastener 116A align and interconnect securing the fabric 102 across the chest of wearer 202 which reorientates the first exterior pocket open end 128 and the second exterior pocket open end 132 perpendicular to the vertical center reference line 338, making the first exterior pocket 104C and the second exterior pocket 104A accessible and useable to wearer 202.

In an exemplary embodiment, a third exterior pocket 104B can be attached on the exterior surface 148 adjacent to and separated by a third margin distance 326 from the second exterior pocket 104A. The third exterior pocket 104B comprises a third exterior pocket open end 134 that is oriented to face the vertical center reference line 338.

In an exemplary embodiment, an interior pocket 126 can be attached to the interior surface 146 along either the first edge 120 or the second edge 122, a fourth margin distance 316 from neckline 114 with an interior pocket open end 130 that is orientated to face and be parallel to the vertical center reference line 338.

In an exemplary embodiment, a third fastener 118B can be attached proximate to neckline 114, adjacent to the first fastener 118A, and separated by a third fastener distance 312. In addition, a fourth fastener 116B can be attached proximate to neckline 114, adjacent to the second fastener 116A, and separated by a fourth fastener distance 306.

In an exemplary embodiment, the first fastener distance 314 and the second fastener distance 310 are equal, and the third fastener distance 312 and the fourth fastener distance 306 are equal, such that the fasteners 118A-B and 116A-B align and are proximate when the wearable cabana 100 is worn by wearer 202.

The first fastener, second fastener, third fastener, and further fastener can be cord loops 118A-B, buttons 116A-B, buckle/buckle receiver 150/152, or other suitable fasteners and can be interchanged, as may be required and/or desired in a particular embodiment.

In an exemplary embodiment, a hood 108 can be attached, in a removable manner such as by hook and loop, snaps, of other suitable method, to neckline 114 and centered with respect to the vertical center reference line 338.

In an exemplary embodiment, the first fastener 118A and the third fastener 118B can be cord loops, and the second fastener 116A and the fourth fastener 116B can be buttons or vice versa.

Referring to FIGS. 11A-11E, there are illustrated examples of accessory options for use with the wearable cabana 100.

In an exemplary embodiment, a bow 138 can be attached in a permanent manner, such as sewn or another method, or in a removable manner, such as by hook and loop, snaps, or another suitable method, to the exterior surface 148 and centered with respect to the vertical center reference line 338. Such accessory ornamentation can be included to personalize the wearable cabana 100. In this regard, such bow 138 can be decorative, in a costume nature, for example, a princess or other costume.

In an exemplary embodiment, a collar 140 can be attached in a permanent manner, such as sewn or another method, or in a removable manner, such as by hook and loop, snaps, or another suitable method to the neckline and centered with respect to the vertical center reference line 338. Such accessory ornamentation can be included to personalize the wearable cabana 100, as well as have functional benefits of keeping the sun from burning the back of the neck of the wearer 202. Such collar 140 can be decorative, in a costume nature, for example, a princess or other costume, or a simple extension of the neckline 114 to protect the back of the neck of the wearer 202.

Based on the spatial arrangement of its modular elements-including the armholes, fasteners, pockets, hood, sleeves, collar, and bow—the wearable cabana apparatus is configurable for use in multiple states. These include a cape configuration (with the neckline behind the neck and fasteners joined across the chest), a towel configuration (with the fabric laid flat), a backpack configuration (by fastening perimeter edges), and a cover-up configuration (wrapped around the torso). The structural geometry of each component relative to the vertical and horizontal reference lines facilitates these arrangements without requiring complex folding or reassembly.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A transformable modular garment apparatus configurable for use in a towel configuration, a cape configuration, a backpack configuration, and a cover-up configuration, the transformable modular garment apparatus comprising:

a fabric body having an exterior surface, an interior surface, a neckline located along a top edge, a bottom edge opposite the top edge, a first edge, a second edge, and a plurality of armholes;

an interior pocket attached to the interior surface, the interior pocket having an interior pocket closed edge extending along the second edge of the fabric body and vertically offset from the neckline by a first margin distance, the interior pocket having an interior pocket open end positioned laterally inward from the interior pocket closed edge and oriented parallel to and facing toward a vertical center reference line extending between a midpoint of the neckline and a midpoint of the bottom edge when the fabric body is in a flat configuration;

a first exterior pocket attached to the exterior surface, the first exterior pocket having a first exterior pocket closed edge extending along the first edge of the fabric body, the first exterior pocket having a first exterior pocket open end positioned laterally inward from the first exterior pocket closed edge and oriented toward the vertical center reference line when the fabric body is in the flat configuration and spaced from the neckline by a second margin distance;

a second exterior pocket attached to the exterior surface, the second exterior pocket having a second exterior pocket closed edge extending along the second edge of the fabric body, the second exterior pocket having a second exterior pocket open end positioned laterally inward from the second exterior pocket closed edge and oriented toward the vertical center reference line when the fabric body is in the flat configuration and spaced from the neckline by a third margin distance;

a third exterior pocket attached adjacent to the second exterior pocket and spaced from the second exterior pocket by a fourth margin distance, the third exterior pocket having a third exterior pocket closed edge extending along the second edge of the fabric body, the third exterior pocket having a third exterior pocket open end positioned laterally inward from the third exterior pocket closed edge and oriented toward the vertical center reference line when the fabric body is in the flat configuration and being fabricated from a mesh material;

a cord loop fastener attached to the exterior surface proximate to the neckline and spaced from the second edge by a first fastener distance;

a button fastener attached to the exterior surface proximate to the neckline and spaced from the first edge by a second fastener distance;

wherein the fabric body is sized to drape over the back of a wearer with the wearer's arms extending through the plurality of armholes of the fabric body;

wherein the first exterior pocket and the second exterior pocket are positioned between the neckline and a horizontal center reference line that bisects the first edge and the second edge;

wherein the second exterior pocket has a second exterior pocket width, wherein the third exterior pocket has a third exterior pocket width, and wherein the second exterior pocket width is one-half or less than the third exterior pocket width; and wherein the cord loop fastener and the button fastener are configured to interconnect across the wearer's chest, thereby drawing the first edge and the second edge toward one another across the wearer's chest and reorienting the interior pocket open end, the first exterior pocket open end, the second exterior pocket open end, and the third exterior pocket open end from an orientation facing toward the vertical center reference line when the fabric body is in the flat configuration to an orientation generally perpendicular to the vertical center reference line when the transformable modular garment apparatus is worn in the cape configuration, thereby positioning the interior pocket, the first exterior pocket, the second exterior pocket, and the third exterior pocket for frontal accessibility by the wearer.

2. The transformable modular garment apparatus of claim 1, wherein the third exterior pocket is oriented downwardly toward the bottom edge of the fabric body when the fabric body is in the flat configuration to retain objects during movement.

3. The transformable modular garment apparatus of claim 1, further comprising:

a second cord loop fastener disposed proximate to and spaced from the first cord loop fastener and spaced from it by a third fastener distance;

a second button fastener disposed proximate to and spaced from the first button fastener and spaced from it by a fourth fastener distance; and wherein the third fastener distance and the fourth fastener distance are equal, and the second cord loop fastener and the second button fastener are configured to provide an optional secondary closure below the neckline.

4. The transformable modular garment apparatus of claim 1, wherein the interior pocket, the first exterior pocket, the second exterior pocket, or the third exterior pocket is lined with an insulating material to preserve thermal conditions of the contents.

5. The transformable modular garment apparatus of claim 1, wherein the interior pocket, the first exterior pocket, the second exterior pocket, or the third exterior pocket includes a closure mechanism selected from the group consisting of hook-and-loop fasteners, magnets, snaps, buttons, or zippers.

6. The transformable modular garment apparatus of claim 1, further comprising a detachable hood centered along the neckline and removably attached using hook-and-loop fasteners or snaps, the hood being configured to overlay the neckline and provide privacy or environmental protection in wearable configurations.

7. The transformable modular garment apparatus of claim 1, further comprising:

a pair of removable shoulder covers, each removably attachable around a respective one of the plurality of armholes defined on the first and second edges of the fabric body to provide partial or full arm coverage.

8. The transformable modular garment apparatus of claim 1, wherein the fabric body comprises a material having a sun protection factor (SPF) rating of at least 25 and optionally 50 or greater, and wherein the fabric is configured to drape over the wearer's chest and back in the cape configuration to protect against ultraviolet radiation.

9. A method of using the transformable modular garment apparatus of claim 1, the method comprising:

wrapping the fabric body around torso of the wearer to form a cover-up configuration;

placing the transformable modular garment in a cape configuration by positioning the neckline behind neck of the wearer and interconnecting at least one of the cord loop fasteners with at least one of the button fasteners;

forming a backpack configuration by folding the perimeter edges of the fabric body and removably fastening at least two corners together to create a strap or enclosed compartment; and deploying the fabric body in a towel configuration by laying it flat on a surface or using it to dry the wearer.

10. A transformable modular garment apparatus configurable for use in a towel configuration, a cape configuration, a backpack configuration, and a cover-up configuration, the transformable modular garment apparatus comprising:

a fabric body having an exterior surface, an interior surface, a neckline located centrally along a top edge of the fabric body, a bottom edge opposite the top edge, a first edge, a second edge, and a plurality of armholes, the interior surface being configured to contact a wearer when worn;

a first exterior pocket attached to the exterior surface, the first exterior pocket having a first exterior pocket closed edge extending along the first edge of the fabric body and being spaced from the neckline by a first margin distance, the first exterior pocket comprising a first exterior pocket open end positioned laterally inward from the first exterior pocket closed edge and oriented parallel to and facing toward a vertical center reference line of the fabric body when the fabric body is in a flat configuration, the first exterior pocket being fabricated from a mesh material configured to allow visibility of its contents and facilitate the escape of sand, dirt, or debris;

a second exterior pocket attached to the exterior surface, the second exterior pocket having a second exterior pocket closed edge extending along the second edge of the fabric body and being spaced from the neckline by a second margin distance, the second exterior pocket comprising a second exterior pocket open end positioned laterally inward from the second exterior pocket closed edge and oriented parallel to and facing toward the vertical center reference line when the fabric body is in the flat configuration, the second exterior pocket being fabricated from a mesh material configured to allow visibility of its contents and facilitate the escape of sand, dirt, or debris;

a plurality of first fasteners attached proximate to the neckline, including at least two first fasteners positioned adjacent to the first exterior pocket;

a plurality of second fasteners attached proximate to the neckline, including at least two second fasteners positioned adjacent to the second exterior pocket;

wherein the first and second fasteners are laterally aligned across the vertical center reference line and configured to interconnect, securing the fabric body across the chest of the wearer;

wherein interconnection of the plurality of first fasteners and the plurality of second fasteners draws the first edge and the second edge toward the vertical center reference line and reorients the first exterior pocket open end and the second exterior pocket open end from an orientation facing toward the vertical center reference line when the fabric body is in the flat configuration to an orientation generally perpendicular to the vertical center reference line when the transformable modular garment apparatus is worn in the cape configuration, thereby positioning the first exterior pocket and the second exterior pocket for frontal accessibility by the wearer;

a detachable hood having a neckline edge removably attachable to the fabric body's neckline using hook-and-loop fasteners or snaps;

a pair of removable sleeves, each sleeve comprising a tubular body having a proximal opening and a distal end, the proximal opening being configured to attach to a corresponding one of the plurality of armholes using mating fasteners disposed around a periphery of the corresponding one of the plurality of armholes;

wherein the pair of removable sleeves are configured to be selectively arranged in a no-shoulder covering configuration, a short shoulder covering configuration, or a full arm coverage configuration, and wherein the no-shoulder and short shoulder configurations are designed to avoid encumbering arm movement;

wherein the fabric body is sized to drape across the back of the wearer, with the wearer's arms positioned through the plurality of armholes;

wherein the first exterior pocket and the second exterior pocket are positioned between the neckline and a horizontal center reference line that bisects the first edge and the second edge; and wherein the alignment and interconnection of the plurality of first fasteners and the plurality of the second fasteners positions the exterior pockets in a frontal orientation with maintained relative spacing for wearer access, and the garment is further configurable to be deployed in a wearable cape configuration, a backpack configuration, or a flat towel configuration based on the arrangement of fasteners proximate to the neckline and edges.

11. The transformable modular garment apparatus of claim 10, further comprising:

a third exterior pocket attached to the exterior surface of the fabric body and positioned between the first exterior pocket and the second exterior pocket, the third exterior pocket being vertically offset from the neckline by a third margin distance distinct from the first and second margin distances;

the third exterior pocket comprising a third exterior pocket open end oriented parallel to and facing toward the vertical center reference line, and fabricated from a mesh material configured to allow visibility of contents and facilitate the escape of sand, dirt, or debris;

wherein the second exterior pocket has a second exterior pocket width, wherein the third exterior pocket has a third exterior pocket width, and wherein the second exterior pocket width is one-half or less than the third exterior pocket width; and wherein the third exterior pocket is oriented downwardly toward the bottom edge of the fabric body when the fabric body is in the flat configuration and is configured to resist displacement of objects during wearer movement.

12. The transformable modular garment apparatus of claim 10, further comprising:

an interior pocket attached to the interior surface of the fabric body, the interior pocket being vertically offset from the neckline by a fourth margin distance;

the interior pocket having an interior pocket closed edge extending along the second edge of the fabric body, and an interior pocket open end positioned laterally inward from the interior pocket closed edge and oriented to face and be parallel to the vertical center reference line when the fabric body is in a flat configuration;

wherein the interior pocket is fabricated from mesh material and includes a pocket fastener disposed along the interior pocket open end, the pocket fastener being configured to selectively close the interior pocket open end to retain items within the interior pocket; and wherein the interior pocket is positioned on the body-facing surface of the fabric such that it is concealed in the cape and backpack configurations and accessible when the garment is in the towel configuration.

13. The Transformable modular garment apparatus of claim 10, further comprising:

a third fastener attached to the exterior surface proximate to the neckline and positioned between one of the plurality of first fasteners and the first exterior pocket open end, the third fastener spaced from the one of the first plurality of fasteners by a third fastener distance;

a fourth fastener attached to the exterior surface proximate to the neckline and positioned between one of the second plurality of fasteners and the second exterior pocket open end, the fourth fastener spaced from the one of the plurality of second fasteners by a fourth fastener distance;

wherein the third and fourth fastener distances are equal, and the third and fourth fasteners are configured to interconnect in addition to or independently of the first and second fasteners;

thereby providing a second closure position below the neckline to support garment stability and to enable reconfiguration between the cape and backpack states while maintaining the relative positioning of the exterior pockets.

14. The transformable modular garment apparatus of claim 10, wherein:

wherein at least one of the plurality of first fasteners and at least one of the plurality of second fasteners comprises a buckle and a corresponding buckle receiver positioned proximate to the neckline;

the buckle and buckle receiver being operable to interconnect and secure the fabric body across the wearer's chest;

wherein the buckle and buckle receiver permit incremental adjustment of the fastened length to accommodate varying chest widths and to tension the fabric across the upper torso; and wherein the buckle and buckle receiver are removably attachable to the fabric body using mating fasteners and are fabricated from a lightweight, durable material.

15. The transformable modular garment apparatus of claim 10, wherein:

the fabric body comprises a material having a sun protection factor (SPF) rating of at least 25 and optionally 50 or greater;

wherein the fabric body is configured to drape over the wearer's upper back, shoulders, and chest in the cape or cover-up configuration to provide ultraviolet protection to exposed areas during outdoor use; and wherein the fastener arrangement maintains coverage of protected areas during movement, reducing the need for additional garments or sunscreen.

16. The transformable modular garment apparatus of claim 10, wherein:

one of the plurality of first fasteners comprises a cord loop, and one of the plurality of second fasteners comprises a button;

the cord loop is configured to receive the button to interconnect the one of the plurality of first fasteners with the one of the plurality of second fasteners across the chest of the wearer; and wherein the cord loop and the button are positioned at corresponding fastener distances from opposite lateral edges of the fabric body to form a symmetrical closure system about the vertical center reference line and secure the fabric body across the chest of the wearer.

17. The transformable modular garment apparatus of claim 10, further comprising:

a bow removably attached to the exterior surface and centered with respect to the vertical center reference line;

wherein the bow is attached using hook-and-loop fasteners or snaps integrated into the exterior surface; and and wherein the bow is configured to align at the intersection of the vertical center reference line and the horizontal center reference line of the fabric body when worn in the cape configuration;

thereby concealing the fastener interconnection point and providing a user-repositionable decorative element.

18. The transformable modular garment apparatus of claim 10, further comprising:

a collar removably attached to the neckline and centered with respect to the vertical center reference line;

wherein the collar comprises a contoured inner edge that aligns with the neckline and an outer edge extending upward and rearward to partially encircle the wearer's neck in the cape configuration when worn; and the collar being fabricated from a thermally insulative or wind-resistant material, and being selectively removable to enable the garment to be configured for cold-weather or warm-weather use.

19. A method of using the transformable modular garment apparatus of claim 10, the method comprising:

placing the garment on a wearer such that the wearer's arms extend through the plurality of armholes of the fabric body and the neckline rests behind the wearer's neck;

interconnecting at least one of the plurality of first fasteners with at least one of the plurality of second fasteners across the front of the wearer, thereby drawing the first edge and the second edge of the fabric body toward the vertical center reference line;

repositioning the first and second exterior pockets into a frontal orientation accessible to the wearer as a result of the interconnection of the fasteners, thereby forming a cape configuration;

disengaging the fasteners and removing the garment from the wearer to deploy the fabric body in a flat towel configuration;

folding the perimeter edges of the fabric body and removably fastening at least two corners together to create a strap or enclosed compartment, thereby forming a backpack configuration for transporting the garment.

* * * * *